US011825921B2

(12) United States Patent
Canivet et al.

(10) Patent No.: US 11,825,921 B2
(45) Date of Patent: Nov. 28, 2023

(54) MODIFIABLE JEWELRY SYSTEM AND METHOD OF USING SAME

(71) Applicants: Katherine Irene Canivet, Asheville, NC (US); Daniel Wallace Canivet, Asheville, NC (US); Douglas Wallace Canivet, Asheville, NC (US)

(72) Inventors: Katherine Irene Canivet, Asheville, NC (US); Daniel Wallace Canivet, Asheville, NC (US); Douglas Wallace Canivet, Asheville, NC (US)

( * ) Notice: Subject to any disclaimer, the term of this patent is extended or adjusted under 35 U.S.C. 154(b) by 147 days.

(21) Appl. No.: 17/494,066

(22) Filed: Oct. 5, 2021

(65) Prior Publication Data

US 2022/0125168 A1 Apr. 28, 2022

Related U.S. Application Data

(60) Provisional application No. 63/104,003, filed on Oct. 22, 2020.

(51) Int. Cl.
*A44C 13/00* (2006.01)
*A44C 11/00* (2006.01)

(52) U.S. Cl.
CPC ..... *A44C 13/00* (2013.01); *A44C 11/00* (2013.01); *A44D 2211/02* (2013.01)

(58) Field of Classification Search
CPC ..... A44C 13/00; A44C 11/00; A44C 5/0007; A44C 17/0208; A44C 17/0241; A44C 25/00; A44C 25/007; A44C 5/00; A44C 5/0084; A44C 5/0092; A44C 9/0053; A44C 15/00; A44D 2211/02
See application file for complete search history.

(56) References Cited

U.S. PATENT DOCUMENTS 2,653,402 A * 9/1953 Bonagura ..... G09F 7/16 63/3
6,065,971 A * 5/2000 Lennon ..... A44C 9/0053 63/3
2020/0337421 A1* 10/2020 Barros ..... A44C 5/0015

* cited by examiner

*Primary Examiner* — Jack W Lavinder
(74) *Attorney, Agent, or Firm* — Ward and Smith, P.A.; Ryan K. Simmons

(57) ABSTRACT

A modifiable jewelry system. The modifiable jewelry system may include a main jewelry body, wherein the main jewelry body may include a track along at least a portion of the main jewelry body and a securing component. The modifiable jewelry system may further include one or more attachable/detachable components, the one or more attachable/detachable components may include a decorative portion and a retaining body portion, wherein the retaining body portion may be configured to be received by the track of the main body, and wherein the received retaining body portion may be releasable retained within an internal portion of the track via the securing mechanism.

14 Claims, 8 Drawing Sheets

MODIFIABLE JEWELRY SYSTEM AND METHOD OF USING SAME

RELATED APPLICATIONS

This application is related and claims priority to U.S. Provisional Patent Application No. 63/104,003, filed on Oct. 22, 2020, the application of which is incorporate herein by reference in its entirety.

TECHNICAL FIELD

The presently disclosed subject matter relates generally to jewelry and more particularly to a modifiable jewelry system and method of using same.

BACKGROUND

It is often desired to change or modify the appearance of a piece of jewelry, e.g., a bracelet, pendant, ring, earring, or other type of fashion accessory, to achieve a different look without having to buy a whole new piece of jewelry. For example, some currently available bracelets can be altered for appearance purposes by, for example, adding or removing components. However, these prior modifiable jewelry constructions fail to provide for a secure and easy way to add or remove components to a piece of jewelry to modify the appearance of the piece of jewelry.

SUMMARY

In one embodiment, a modifiable jewelry system is provided. The modifiable jewelry system may include a main jewelry body, wherein the main jewelry body may include a track along at least a portion of the main jewelry body and a securing component. The modifiable jewelry system may further include one or more attachable/detachable components, the one or more attachable/detachable components may include a decorative portion and a retaining body portion, wherein the retaining body portion may be configured to be received by the track of the main body, and wherein the received retaining body portion may be releasable retained within an internal portion of the track via the securing mechanism. A bottom profile of the decorative portion of the one or more attachable/detachable components substantially conforms with an outer surface profile of the main jewelry body. The main jewelry body may further include a first wall and an opposing second wall along at least a portion of its length, the first second wall extending upward from a surface thereof. A top surface of the decorative portion of an installed one or more attachable/detachable components may be substantially level with a top edge of the first and second wall. The track may include opposing upper inside edges forming a gap therebetween, wherein the gap is narrower than the internal portion of the track. The retaining body portion may be connected to a bottom portion of the decorative portion of the one or more attachable/detachable components by a post, wherein the post may have a thickness less than that of the retaining body. The post may include a thickness that is substantially the same as or slightly less than a width of the gap formed between the opposing upper inside edges of the track. The track may include at least one opening having a sufficient size and shape such that the retaining body portion can pass therethrough. The retaining body portion may be of a size and shape that substantially conforms to a cross sectional shape of the internal portion of the track of the main jewelry body.

The retaining body portion of the one or more attachable/detachable components may be received within the track of the main jewelry body, the one or more attachable/detachable components may be slideable along the track. The securing component may include a spring biased element that is configured to allow for the retaining body portion of the one or more attachable/detachable components to be inserted into the internal portion of the track while also preventing the retaining body portion from unintentionally releasing from the internal portion of the track. The securing component may be integral with a lower portion of the main jewelry body. The spring biased element of the securing component may include a resilient strip, wherein the resilient strip may be affixed to the internal portion of the track at a first end and may include a protrusion disposed at a second end thereof. The spring biased element of the securing component may be affixed to the internal portion of the track in a manner such that in an unbiased state the second end protrudes at least partially into the internal portion of the track. The system may further include a locking mechanism, wherein the locking mechanism may be configured to lock one or more of an installed attachable/detachable component in place at any place along the track.

In another embodiment, a method of installing one or more attachable/detachable components to a modifiable jewelry system is provided. The method may include providing a modifiable jewelry system; inserting the retaining body portion of at least one of the one or more attachable/detachable components through an opening of the track into the internal portion thereof, wherein the opening is of a sufficient size and shape such that the retaining body portion can pass therethrough; and sliding the at least one of the one or more attachable/detachable components along the track such that its retaining body portion moves past the securing mechanism.

In yet another embodiment, a method of removing one or more attachable/detachable components from a modifiable jewelry system is provided. The method may include providing a modifiable jewelry system with one or more attachable/detachable components installed thereon; sliding one of the installed attachable/detachable component along the track such that its retaining body portion moves proximate to the securing mechanism; further sliding the installed attachable/detachable component along the track such that the retaining body portion pushes the securing mechanism out of the way and is aligned with an opening in the track, wherein the opening is of a sufficient size and shape such that the retaining body portion can pass therethrough; and removing the retaining body portion of the attachable/detachable component through the opening of the track.

BRIEF DESCRIPTION OF THE DRAWINGS

Figure 1A:
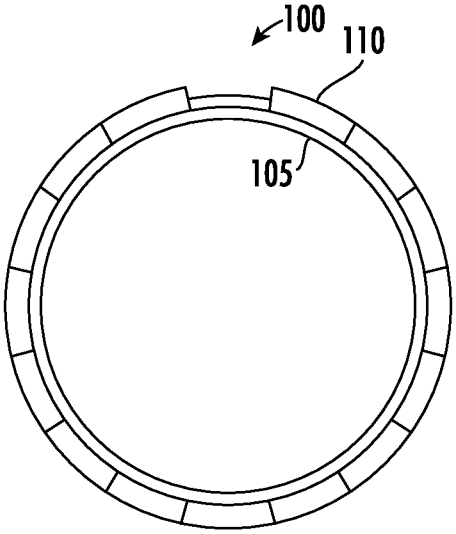
Figure 1B:
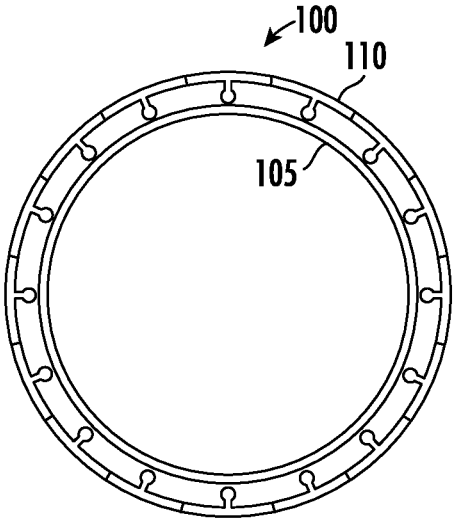
Figure 1C:
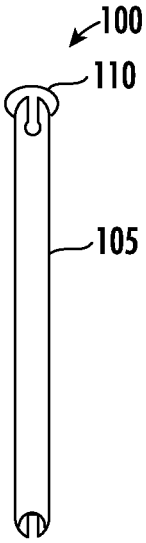
Figure 2A:
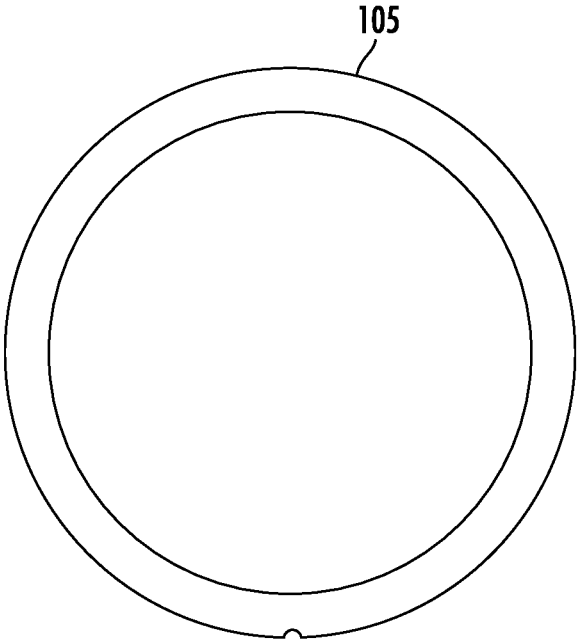
Figure 2B:
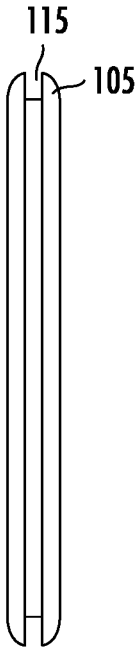
Figure 2C:
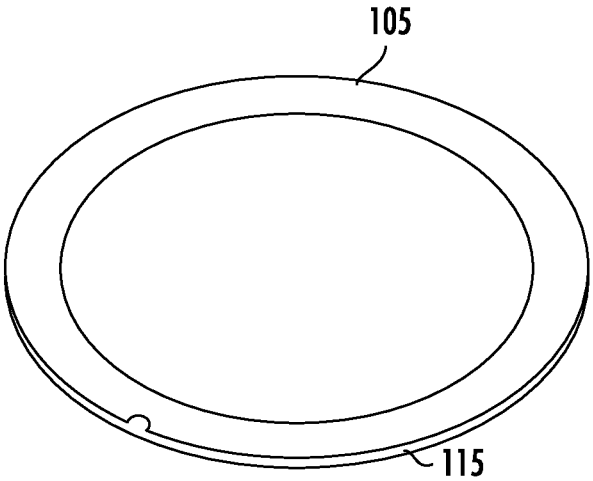
Figure 2D:
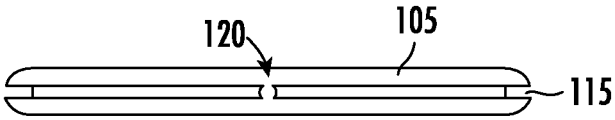
Figure 3A:
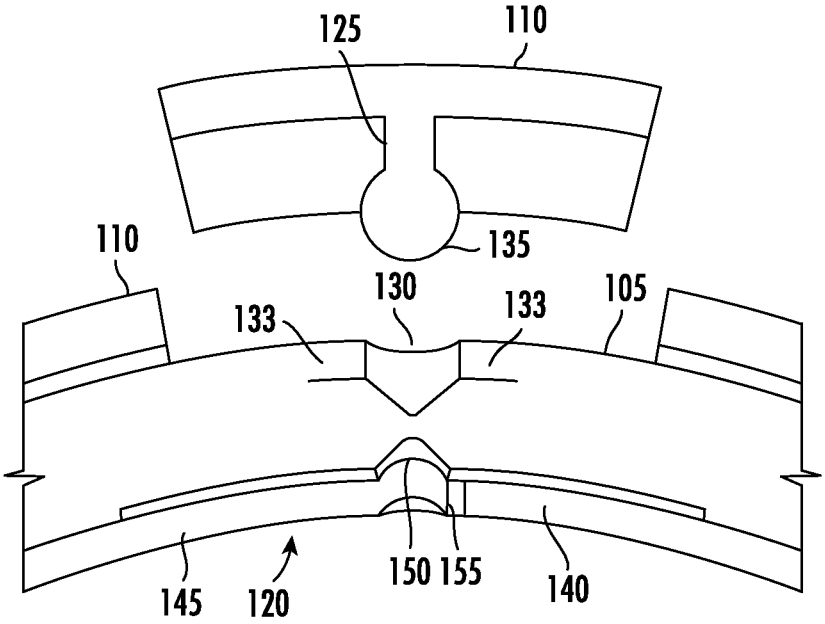
Figure 3B:
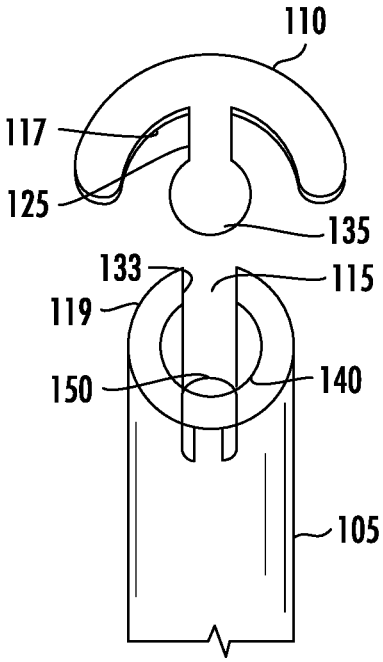
Figure 4A:
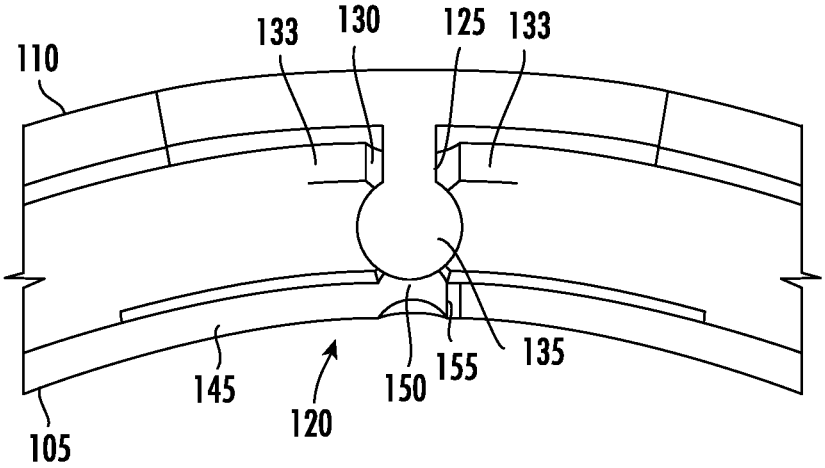
Figure 4B:
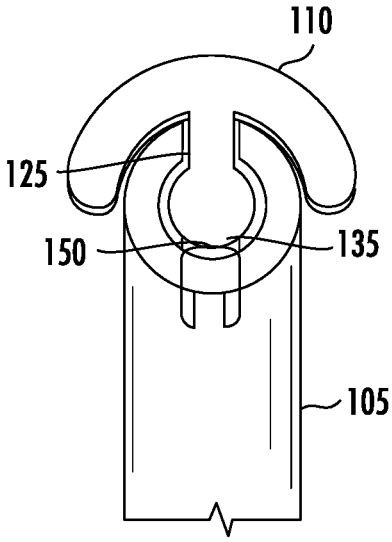
Figure 5A:
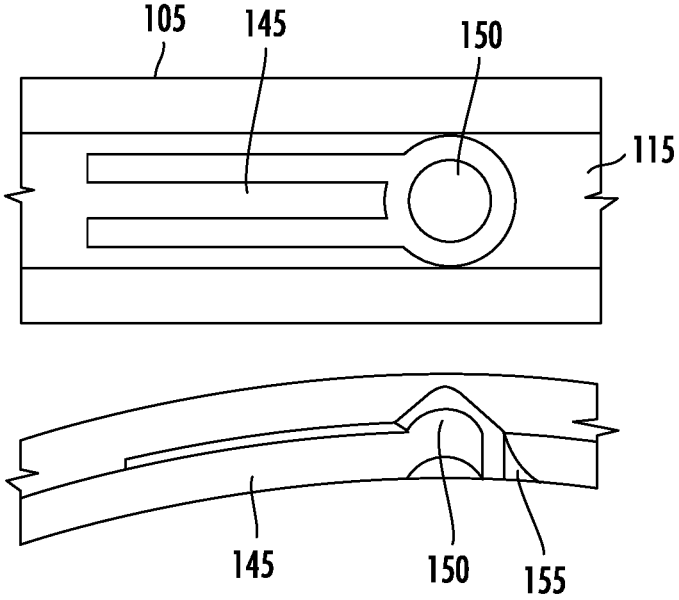
Figure 5B:
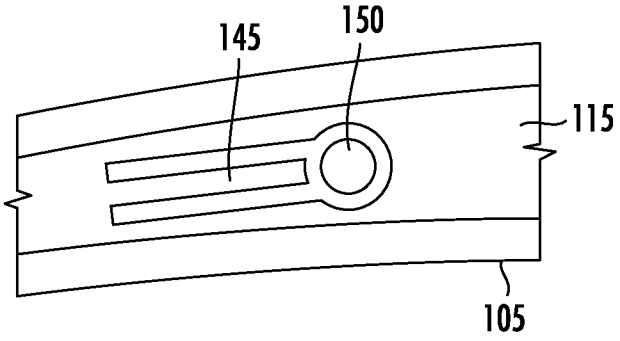
Figure 6:
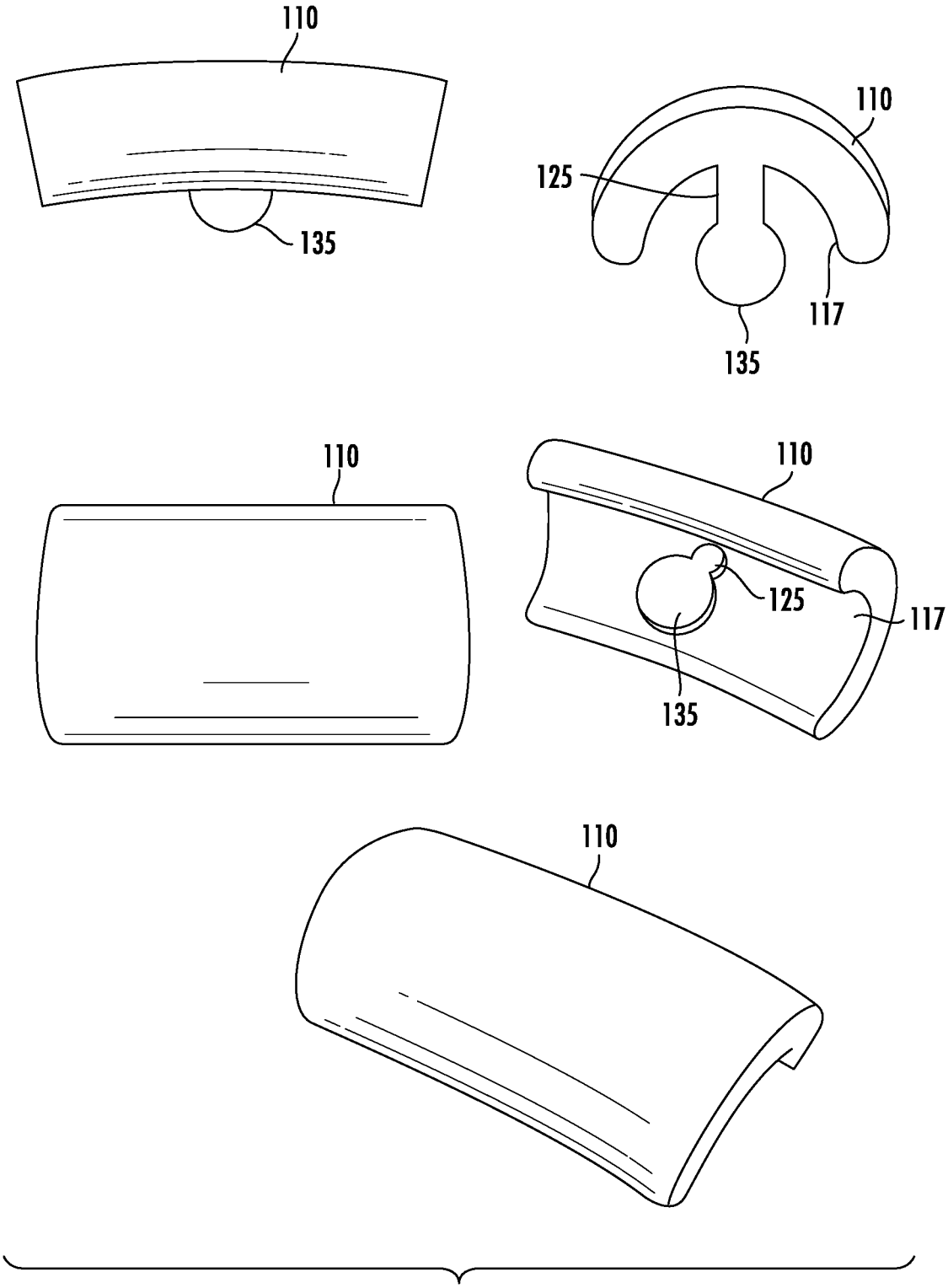
Figure 7A:
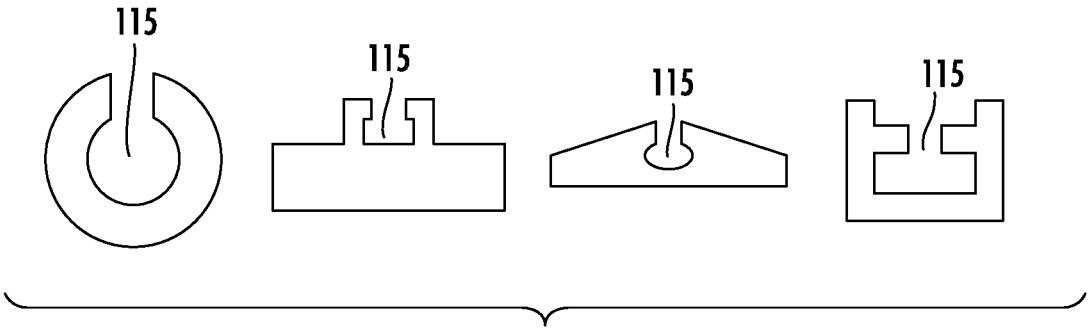
Figure 7B:
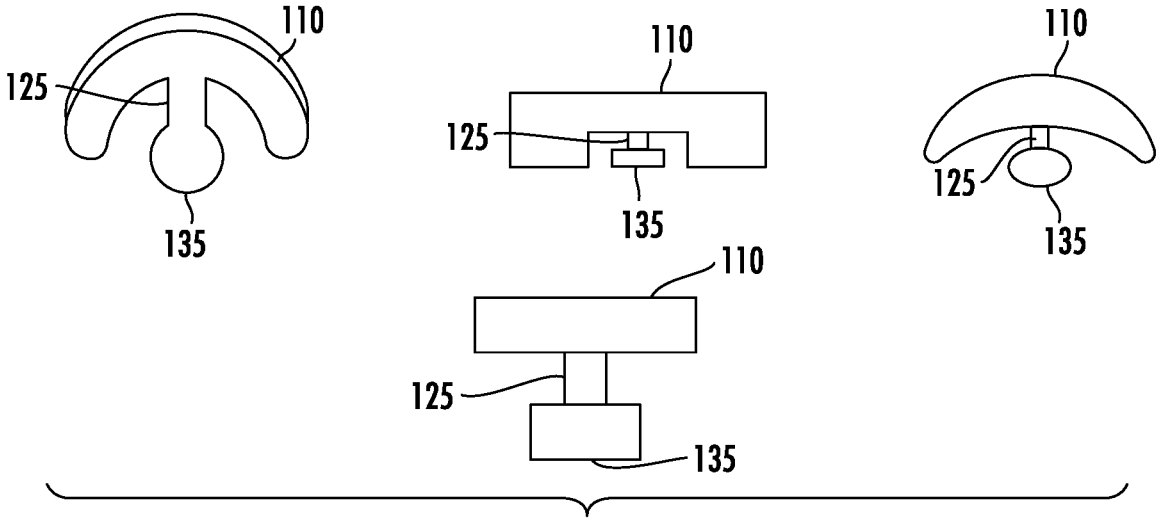
Figure 8:
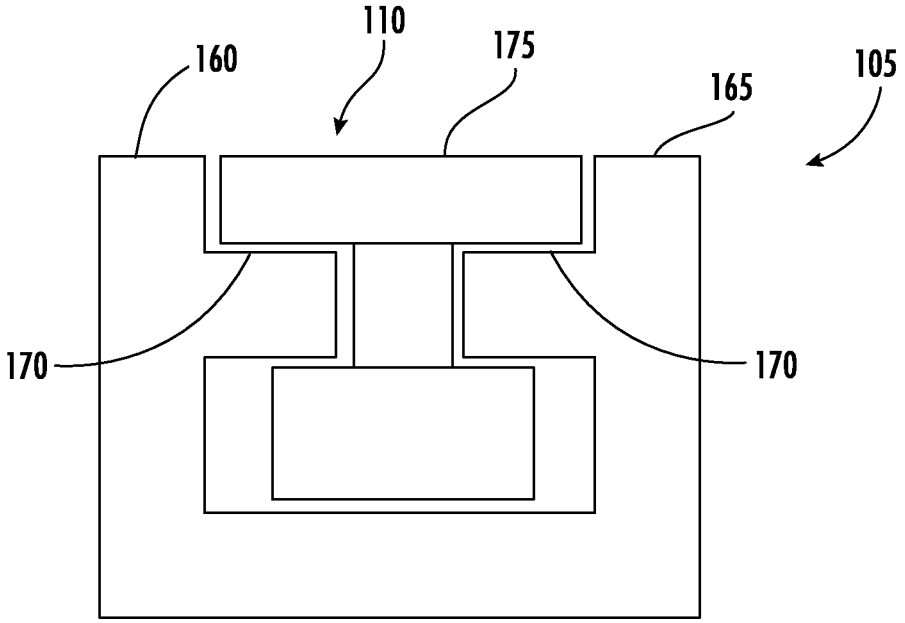

Having thus described the presently disclosed subject matter in general terms, reference will now be made to the accompanying drawings, which are not necessarily drawn to scale, and wherein:

FIGS. 1A, 1B, and 1C illustrate a side view, cross-sectional side view, and a cross-sectional front view of a modifiable jewelry system 100 in accordance with an embodiment of the invention;

FIGS. 2A, 2B, 2C and 2D illustrate a side view, front view, perspective view, and a flat rear view of a main body portion of the modifiable jewelry system 100 in accordance with an embodiment of the invention;

FIGS. 3A and 3B illustrate a partial cross-sectional side view and a partial cross-sectional front view of a component prior to being installed to the main body portion in accordance with an embodiment of the invention;

FIGS. 4A and 4B illustrate a partial cross-sectional side view and a partial cross-sectional front view of a component installed with the main body portion in accordance with an embodiment of the invention;

FIGS. 5A and 5B illustrate a partial cross-sectional side view and a partial cross-sectional top view of a securing component in accordance with an embodiment of the invention;

FIG. 6 illustrates various views of an attachable/detachable component in accordance with an embodiment of the invention;

FIG. 7A illustrates cross-sectional front views of various track/channel profiles in accordance with embodiments of the invention;

FIG. 7B illustrates cross-sectional front views of various attachable/detachable component profiles in accordance with embodiments of the invention;

FIG. 8 illustrates an example cross-sectional view of a track/channel profile with an attachable/detachable component profile therein, in accordance with an embodiment of the invention.

DETAILED DESCRIPTION

The subject matter of the invention now will be described more fully hereinafter with reference to the accompanying drawings, in which some, but not all embodiments of the subject matter of the invention are shown. Like numbers refer to like elements throughout. The subject matter of the invention may be embodied in many different forms and should not be construed as limited to the embodiments set forth herein; rather, these embodiments are provided so that this disclosure will satisfy applicable legal requirements. Indeed, many modifications and other embodiments of the subject matter of the invention set forth herein will come to mind to one skilled in the art to which the subject matter of the invention pertains having the benefit of the teachings presented in the foregoing descriptions and the associated Drawings. Therefore, it is to be understood that the subject matter of the invention is not to be limited to the specific embodiments disclosed and that modifications and other embodiments are intended to be included within the scope of the appended claims.

In some embodiments, the subject matter of the invention provides a modifiable piece of jewelry, such as a bracelet, pendant, ring, earring, or other type of fashion accessory that may include a track or channel and securing mechanism for the secure attachment/detachment of various components to modify the appearance of the piece of jewelry.

Referring now to FIGS. 1-7B, illustrate a modifiable jewelry system 100 that may include a main body 105 and one or more attachable/detachable components 110. In one non-limiting example, modifiable piece of jewelry system 100 may be a bracelet. Main body 105 may include a track/channel 115 and a securing component 120, for example, a catch or spring component. Securing component 120 allows for one or more attachable/detachable components 110 to be easily inserted into the track or channel 115 of the main body 105, while also preventing the one or more components 110 from falling out of the track/channel 115. In one embodiment, the track/channel 115 may be formed about a circumference of the main body 105.

The track/channel 115 may be of various dimensions depending on its intended application (e.g., pendant, ring, earring, bracelet, or other type of fashion accessory).

The one or more attachable/detachable components 110 may be of various dimensions. The contour of the underside surface (lower surface 117) of the components 110 preferably matches or closely matches the upper outer surface (e.g., outer surface 119), of the main body 105. Attachable/detachable components 110 may further include a post 125 projecting from its underside. Post 125 may have a shape that conforms closely to upper inside edges 133 of the track/channel 115. In one example, post 135 has a thickness that is substantially the same as or slightly less than the width between opposing upper inside edges 133. Post 125 may further include a retaining body 135 incorporated at a bottom portion of the post 125. Retaining body 135 preferably is of a size and shape that conforms to the internal shape of the track/channel 115, such that the component 110 cannot be pulled vertically out of the track/channel 115 except at a point of the track/channel 115 where opening 130 is positioned, which permits the post 125 and the retaining body 135 portion to pass through it. In a preferred embodiment retaining body 135 is wider than post 125. The cross sectional shape of post 125 may be round, square, rectangular, triangular, ovular, or any other suitable shape. The retaining body 135 may be round, square, rectangular, triangular, ovular, or any other suitable shape.

In one embodiment, the securing component 120 may be integral to a lower portion 140 of the track/channel 115, or may be made of a different material, e.g., material with greater resilient properties, than that of track/channel 115 and affixed to the track/channel 115 during manufacture. In one example, securing component 120 may include a catch or spring type component that may include a flat flexible or semi-flexible strip of resilient material, e.g., strip 145. The securing component 120 may include a protrusion or bump, e.g., catch 150, formed at one end of the resilient strip 145. The end of the strip 145 opposite the catch 150, may be affixed to the track/channel 115 such that the strip 145, and therefore catch 150, can move when levered up or down. The catch 150 may be positioned in the track/channel 115 at a point below the opening 130, and such that when at rest (i.e., not being levered), protrudes at least partially into the track/channel 115.

In one example, one or more components 110 may be attached to the main body 105 by pushing the catch 150 down, allowing retaining body 135 and post 125 to move down into the internal space of the track/channel 115. Once inserted into the track/channel 115, and slid past the catch 150, the resiliency of resilient strip 145 moves the catch 150 back in place, e.g., at least partially into the track/channel 115, thereby preventing the one or more installed components 110 from falling out of the track/channel 115. To remove an installed component 110, a wearer/user may pull or push the catch 150 downward a sufficient amount to allow the post 125 and retaining body 135 to pass by the catch 150 and up through the opening 130. In one embodiment, the wearer/user may pull downward on an undercut 155, formed in an underside of the main body 105, to bend the resilient strip 145 downward and thereby also moving catch 150 out of the path of the post 125 and retaining body 135, so that the component 110 can be removed through opening 130.

The main body 105 may further include a first wall 160 and an opposing second wall 165 along at least a portion of its length, the first wall 160 second wall 165 each extending upward from a surface 170 of main body 105. A top surface 175 of the decorative portion of an installed one or more attachable/detachable components 110 may be substantially level with a top edge of the first wall 160 and second wall 165.

In another embodiment, the modifiable piece of jewelry 100 may further include a locking component (not shown). The locking component may lock one or more installed components 110 in place at any place along the track/channel 115.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A modifiable jewelry system, comprising:

a. a main jewelry body, wherein the main jewelry body comprises a track along at least a portion of the main jewelry body and a securing component; and b. one or more attachable/detachable components, the one or more attachable/detachable components comprising a decorative portion and a retaining body portion, wherein the retaining body portion is configured to be received within the track of the main body, and wherein the received retaining body portion is releasable retained within an internal portion of the track via the securing mechanism; and wherein the securing component comprises a spring biased element that is configured to allow for the retaining body portion of the one or more attachable/detachable components to be inserted into the internal portion of the track while also preventing the retaining body portion from unintentionally releasing from the internal portion of the track once inserted therein, and wherein the spring biased element of the securing component comprises a resilient strip, wherein the resilient strip is affixed to the internal portion of the track at a first end and includes a protrusion disposed at a second end thereof.

2. The system of claim 1, wherein a bottom profile of the decorative portion of the one or more attachable/detachable components substantially conforms with an outer surface profile of the main jewelry body.

3. The system of claim 1, wherein the main jewelry body further comprises a first wall and an opposing second wall along at least a portion of its length and extending upward from a surface thereof.

4. The system of claim 3, wherein a top surface of the decorative portion of an installed one or more attachable/detachable components is substantially level with a top edge of the first and second wall.

5. The system of claim 1, wherein the track comprises opposing upper inside edges forming a gap therebetween, wherein the gap is narrower than the internal portion of the track.

6. The system of claim 5, wherein the retaining body portion is connected to a bottom portion of the decorative portion of the one or more attachable/detachable components by a post, wherein the post has a thickness less than that of the retaining body.

7. The system of claim 6, wherein the post comprises a thickness that is substantially the same as or slightly less than a width of the gap formed between the opposing upper inside edges of the track.

8. The system of claim 1, wherein the track comprises at least one opening having a sufficient size and shape such that the retaining body portion can pass through the opening into the internal portion of the track.

9. The system of claim 1, wherein the retaining body portion is of a size and shape that substantially conforms to a cross sectional shape of the internal portion of the track of the main jewelry body.

10. The system of claim 1, wherein when the retaining body portion of the one or more attachable/detachable components is received within the track of the main jewelry body, the one or more attachable/detachable components are slideable along the track.

11. The system of claim 1, wherein the securing component is integral with a lower portion of the main jewelry body.

12. The system of claim 1, wherein the spring biased element of the securing component is affixed to the internal portion of the track in a manner such that in an unbiased state the second end protrudes at least partially into the internal portion of the track.

13. A method of installing one or more attachable/detachable components to a modifiable jewelry system, the method comprising:

a. providing a modifiable jewelry system, comprising:

i. a main jewelry body, wherein the main jewelry body comprises a track along at least a portion of the main jewelry body and a securing component; and ii. one or more attachable/detachable components, the one or more attachable/detachable components comprising a decorative portion and a retaining body portion, wherein the retaining body portion is configured to be received by the track of the main body, and wherein the received retaining body portion is capable of being releasable retained within an internal portion of the track via the securing mechanism; and wherein the securing component comprises a spring biased element that is configured to allow for the retaining body portion of the one or more attachable/detachable components to be inserted into the internal portion of the track while also preventing the retaining body portion from unintentionally releasing from the internal portion of the track once inserted therein, and wherein the spring biased element of the securing component comprises a resilient strip, wherein the resilient strip is affixed to the internal portion of the track at a first end and includes a protrusion disposed at a second end thereof;

b. inserting the retaining body portion of at least one of the one or more attachable/detachable components through an opening of the track into the internal portion thereof, wherein the opening is of a sufficient size and shape such that the retaining body portion can pass therethrough; and c. sliding the at least one of the one or more attachable/detachable components along the track such that its retaining body portion moves past the securing mechanism.

14. A method of removing one or more attachable/detachable components from a modifiable jewelry system, the method comprising:

a. providing a modifiable jewelry system, comprising:

i. a main jewelry body, wherein the main jewelry body comprises a track along at least a portion of the main jewelry body and a securing component; and ii. one or more attachable/detachable components installed thereon, the one or more attachable/detachable components comprising a decorative portion and a retaining body portion, wherein the retaining body portion is configured to be received by the track of the main body, and wherein the received retaining body portion is releasable retained within an internal portion of the track via the securing mechanism;

b. sliding one of the installed attachable/detachable components along the track such that its retaining body portion moves proximate to the securing mechanism;

c. further sliding the installed attachable/detachable component along the track such that the retaining body portion pushes the securing mechanism out of the way and the retaining body portion is aligned with an opening in the track, wherein the opening is of a sufficient size and shape such that the retaining body portion can pass therethrough; and d. removing the retaining body portion of the attachable/detachable component through the opening of the track.

* * * * *